US009187161B2

(12) United States Patent
Lambertus

(10) Patent No.: US 9,187,161 B2
(45) **Date of Patent: *Nov. 17, 2015**

(54) WEAPON CLEARANCE APPLIANCE FOR CLEARING WEAPONS, SUCH AS UNDERWATER MINES, UNDER WATER, UNMANNED UNDERWATER VEHICLE HAVING A WEAPON CLEARANCE APPLIANCE OF THIS KIND, AND METHOD FOR THIS PURPOSE

(71) Applicant: Atlas Elektronik GMBH, Bremen (DE)

(72) Inventor: Detlef Lambertus, Hassendorf-Sottrum (DE)

(73) Assignee: Atlas Elektronik GmbH (DE)

( * ) Notice: Subject to any disclaimer, the term of this patent is extended or adjusted under 35 U.S.C. 154(b) by 0 days.

This patent is subject to a terminal disclaimer.

(21) Appl. No.: 14/696,665

(22) Filed: Apr. 27, 2015

(65) Prior Publication Data

US 2015/0225050 A1 Aug. 13, 2015

Related U.S. Application Data

(60) Continuation of application No. 14/308,246, filed on Jul. 1, 2014, now Pat. No. 9,016,185, which is a division of application No. 13/811,691, filed as application No. PCT/EP2011/054809 on Mar. 29, 2011, now Pat. No. 8,807,002.

(30) Foreign Application Priority Data

Aug. 6, 2010 (DE) ..... 10 2010 033 638

(51) Int. Cl.

| | |
|---|---|
| ***B63G 7/06*** | (2006.01) |
| ***B63G 7/02*** | (2006.01) |
| ***B63G 7/08*** | (2006.01) |
| *B63G 7/00* | (2006.01) |

(52) U.S. Cl.
CPC .. *B63G 7/02* (2013.01); *B63G 7/06* (2013.01); *B63G 7/08* (2013.01); *B63G 2007/005* (2013.01)

(58) Field of Classification Search
CPC ..... F41H 11/12; F41H 11/16; F41H 11/32; B63G 8/00; B63G 8/001; B63G 7/00; B63G 2007/005; B63G 7/06; B63G 7/08
USPC ..... 89/1.13, 5; 86/50; 114/316; 102/403
See application file for complete search history.

(56) References Cited

U.S. PATENT DOCUMENTS 3,880,103 A 4/1975 Talkington

FOREIGN PATENT DOCUMENTS

| | | | |
|---|---|---|---|
| DE | 301215 A7 | | 10/1992 |
| FR | 2750946 A1 | | 1/1998 |
| GB | 2234203 | * | 1/1991 |

OTHER PUBLICATIONS

International Search Report from corresponding International Application No. PCT/EP2011/054809, mailed Jul. 13, 2011 (English Translation included).

*Primary Examiner* — Joshua Freeman
(74) *Attorney, Agent, or Firm* — Polster Lieder

(57) ABSTRACT

The present disclosure provides a method for clearing weapons that have been sunk in waterways using a weapon clearance appliance. The weapon clearance appliance comprises means for detachable connection to an unmanned underwater vehicle, so that the underwater vehicle is a safe distance away when the weapon is detonated. The volume of the weapon clearance appliance is chosen such that the buoyancy force which acts on the weapon clearance appliance under water compensates for the force of gravity acting on the weapon clearance appliance. Therefore, the weapon clearance appliance has neutral buoyancy, as a result of which, after the weapon clearance appliance has been released from the underwater vehicle, there is no need to retrim the underwater vehicle. Therefore, there is no need for trimming devices on the underwater vehicle.

15 Claims, 3 Drawing Sheets

WEAPON CLEARANCE APPLIANCE FOR CLEARING WEAPONS, SUCH AS UNDERWATER MINES, UNDER WATER, UNMANNED UNDERWATER VEHICLE HAVING A WEAPON CLEARANCE APPLIANCE OF THIS KIND, AND METHOD FOR THIS PURPOSE

CROSS-REFERENCE TO RELATED APPLICATIONS

This application is a continuation of U.S. patent application Ser. No. 14/308,246, filed Jul. 1, 2014, which is a divisional of U.S. patent application Ser. No. 13/811,691 filed on Jan. 23, 2013, which is a US national stage under 35 U.S.C. §371 of International Application No. PCT/EP2011/054809, which was filed on Mar. 29, 2011 and which claims the priority of application DE 10 2010 033 638.6 filed on Aug. 6, 2010 the contents of each (text, drawings and claims) is incorporated here by reference in their entirety.

FIELD

The invention relates to a weapon clearance appliance for clearing weapons, such as underwater mines or munitions which have been sunk in waterways, under water by detonation of the weapon. The invention further relates to an unmanned underwater vehicle having such a weapon clearance appliance. Finally, the invention relates to a corresponding method for clearing weapons by using such a weapon clearance appliance.

BACKGROUND

Weapons located in waterways, such as underwater mines or munitions which have been sunk, represent a potential danger for marine navigation and the environment. Such weapons are often still located in waterways decades after hostile action. There is, therefore, a need for efficient, cost-effective and safe clearance of such weapons.

Various methods have been conventionally used for clearing such weapons.

A technically uncomplicated but dangerous method for weapon clearance provides for divers to dive down to the corresponding weapon object(s) and to attach a clearance charge manually to the objects in order to detonate the objects. However, on the one hand, this method is dangerous for the diver as he comes directly into contact with the weapon. On the other hand, the use of divers is limited to the maximum diving depth of a diver. Weapons which are located at a deeper level are, therefore, not able to be cleared in this manner.

A further method provides for a clearance charge to be deposited by means of an unmanned underwater vehicle in the region of the weapon object, by means of a manipulator attached to the underwater vehicle. However, this attachment requires clearance charges using high amounts of explosives in order to be able to dispose of the weapon effectively. Often, a single clearance charge already has 30 to 100 kg of explosives which the underwater vehicle has to transport to the weapon and deposit there. Such a large mass of explosive, however, has the following drawbacks.

One the one hand, such a high mass requires complex trimming devices on the underwater vehicle as, after depositing the clearance charge, the trimming of the underwater vehicle is permanently affected. This has the result that the design of the underwater vehicle also has to be correspondingly large and complex. As a result, this increases the cost not only of the underwater vehicle but also of various additional devices, such as for example cranes and storage surfaces provided on board a mother vessel, i.e. the facilities for accommodating equipment on board the mother vessel also have to have correspondingly large dimensions.

On the other hand, such large quantities of explosive material are extremely dangerous, as even with a small number of clearance charges, very large amounts of explosive material have to be loaded on board the mother vessel. This involves particularly stringent safety precautions which significantly increase the costs of the weapon clearance operations.

According to a further method, unmanned underwater vehicles are used as mine destruction drones, such as for example the unmanned underwater vehicles marketed by the under the trade name "Seefuchs" and/or "Seafox". In such mine destruction drones, shaped charges are fitted with only a small amount of explosive material, for example one to two kilograms. For mine destruction and/or general weapon disposal, the mine destruction drone is moved directly adjacent to the object to be destroyed. The shaped charge is then fired within the underwater vehicle, the underwater vehicle being detonated together with the object. This method is highly efficient and also requires only a small amount of explosive material. However, the method is costly as an underwater vehicle is lost with each use.

In view of the above, the object of the invention is to make the weapon clearance under water cheaper, but without substantially increasing the amount of explosive material required.

SUMMARY

The invention achieves this object by a weapon clearance appliance, an unmanned underwater vehicle having such a weapon clearance appliance, as well as by a method for the clearance of weapons using such a weapon clearance appliance as described and claimed below.

The invention is based on the recognition that the use of small explosive charges requires the explosive charge to be positioned exactly adjacent to and/or in the region of the weapon. A small amount of explosive material is sufficient to destroy the weapon only if the explosive charge is positioned accurately.

Moreover, small quantities of explosive material permit the use of small underwater vehicles, whereby the costs of weapon clearance operations can be kept low.

The invention is based on the further recognition that, due to the use of small underwater vehicles, the self-trimming of the underwater vehicle can be permanently affected in a negative manner, when the clearance charge is separated from the underwater vehicle. Insufficient self-trimming, however, leads either to loss of the underwater vehicle as it is no longer able to be controlled or to time-consuming retrimming, whereby the duration of the missions is significantly lengthened.

According to the invention, therefore, it is provided that the weapon clearance appliance is not an integral component of an underwater vehicle but is simply provided as an attachment for an unmanned underwater vehicle. The underwater vehicle thus only serves as a transport vehicle for the actual weapon clearance appliance, which is released from the underwater vehicle in the region of the weapon and/or adjacent to the weapon. To this end, the weapon clearance appliance has means for the releasable connection to the underwater vehicle. The weapon clearance appliance is thus separated from the underwater vehicle in the region of the weapon, so that the underwater vehicle is able to move away from the danger area before the detonation of the weapon.

The volume of the weapon clearance appliance is thus selected such that the buoyancy force acting on the weapon clearance appliance under water compensates for the force of gravity acting on the weapon clearance appliance. The weapon clearance appliance thus has neutral buoyancy. A release of the weapon clearance appliance from the underwater vehicle therefore does not lead to a change in the (positive or negative) buoyancy of the underwater vehicle. The underwater vehicle is, therefore, also able to be easily controlled, even after the weapon clearance appliance has been released from the underwater vehicle.

The invention thus advantageously permits the use of small unmanned underwater vehicles which do not require any complex equipment for neutralizing buoyancy and/or trimming. The invention thus provides the possibility of using small, low-cost underwater vehicles which can be reused after use, as the actual weapon clearance appliance is arranged separately and such that it is able to be separated from the underwater vehicle.

In accordance with a method of the invention it is, therefore, provided initially for a clearance charge comprising explosive material and/or a spoof device for simulating characteristics of marine vessels or submarines to be positioned, i.e. in particular attached or deposited, on the weapon or in the region of the weapon by means of a weapon clearance appliance according to the invention attached to an unmanned underwater vehicle. Such a spoof device serves to deceive the fuse of a mine, which thus activates its own firing mechanism and thus is automatically detonated and is thus cleared.

After the positioning of the weapon clearance appliance with the clearance charge and/or spoof device, the weapon clearance appliance is released from the unmanned underwater vehicle. The unmanned underwater vehicle is then moved away from the weapon to a distance which is greater than or equal to a predetermined safety distance. Subsequently, the explosive charge and/or spoof device is activated so that the weapon is detonated.

According to a particular embodiment, the mass distribution inside the weapon clearance appliance is selected such that, irrespective of the alignment of the weapon clearance appliance in the water, an alignment moment does not act on the weapon clearance appliance. As a result, the weapon clearance appliance is designed such that it not only has neutral buoyancy but remains in the water in any position and/or alignment without any torque acting on the weapon clearance appliance. The mass distribution is, therefore, advantageously selected such that the resulting buoyancy force for the entire weapon clearance appliance acts at the same point as the resulting force of gravity acting on the entire weapon clearance appliance. In this manner, the release of the weapon clearance appliance from the unmanned vehicle does not produce a torque on the underwater vehicle which would have to be compensated by changing the trimming.

According to a particular embodiment, the weapon clearance appliance has one or more clearance charges with a directional effect, in particular one or more shaped charges and a fuse for firing the clearance charge(s). The use of clearance charges with a directional effect increases the efficiency of the explosive material used. This measure contributes to keeping the amount of explosive material to be transported on board the mother vessel low. This leads to non-stringent safety requirements during the transportation and storage of the weapon clearance appliances on board the respective mother vessel.

In a further particular embodiment it is provided that, alternatively or additionally to one or more clearance charges, the weapon clearance appliance has a spoof device for simulating characteristics of a marine vessel or submarine. Such spoof devices are advantageously of the acoustic or magnetic type. Preferably, such a spoof device has means for generating marine vessel noise or submarine noise and thus simulates the presence of a marine vessel or submarine in the region of a mine. The firing mechanism provided in a mine reacts, depending on the type of mine, to such noise and causes the mine to detonate. In this manner, a weapon can be cleared by means of a spoof device, even without the use of additional explosive material.

Additionally or alternatively, such a spoof device has means for generating a magnetic field. Often, firing devices in underwater mines react to changes in the earth's magnetic field as a result of metal marine vessel hulls and/or submarine hulls. By generating an artificial magnetic field, a magnetic field sensor in the firing mechanism of an underwater mine can be deceived, such that it causes the underwater mine to detonate.

According to a particular embodiment, the weapon clearance appliance comprises the following means for activating the fuse and/or the spoof device: a radio buoy which can be released from the weapon clearance appliance for receiving an activation signal via a radio link; and/or an electro-acoustic transducer for generating an activation signal via an acoustic channel; and/or a firing cable for receiving an activation signal via the firing cable; and/or a time fuse.

Such means permit simple activation of the weapon clearance appliance in order to cause the weapon to detonate. A radio buoy connected to the weapon clearance appliance via a line, the radio buoy rising to the surface of the water after the weapon clearance appliance has been positioned adjacent to and/or in the region of the weapon, permits communication with the mother vessel and/or the control platform via a radio link. This is advantageous as an activation signal can thus be transmitted easily to the weapon clearance appliance over a long distance. Thus, even long safety distances can be easily maintained.

In contrast, the use of an electro-acoustic transducer for receiving an activation signal via an acoustic signal has cost advantages, as a costly radio buoy can be dispensed with. However, such an acoustic channel can be negatively affected due to temperature stratifications or salt content stratifications in the water.

A firing cable for receiving an activation signal is also a robust alternative, and which is suitable in particular for short distances.

Finally, a time fuse mechanism is a highly cost-efficient variant which can be used, in particular, when it is ensured that at the firing time there is no danger to people and equipment in the detonation radius.

According to a further particular embodiment, the weapon clearance appliance has a retaining device for fixing the weapon clearance appliance to and/or in the region of the weapon. Such a retaining device for fixing ensures that the weapon clearance appliance remains in the correct position and alignment to the weapon, even when the unmanned underwater vehicle has moved away from the weapon and the weapon clearance appliance is subjected, for example, to a current. The exact alignment of the weapon clearance appliance relative to the weapon advantageously permits the use of only small amounts of explosive material, which is advantageous for the reasons already mentioned above, relative to the safety requirement for the storage and transportation of explosive material.

Preferably, such a retaining device for fixing the weapon clearance appliance to and/or in the region of the weapon comprises a nail-firing device, an electromagnet, a reduced-pressure device and/or a clamping device for clamping the weapon and/or parts thereof and/or objects in the region of the weapon.

Advantageously, such retaining devices are activated by the weapon clearance appliance making contact with the weapon. Additionally or alternatively, such a retaining device can be activated by metal sensors, which signal that the weapon clearance appliance is located immediately in the vicinity of a mine or munitions parts.

The activation of the retaining device in such a manner does not require any alteration to the design of existing underwater vehicles. Thus, the weapon clearance appliance can be used cost-effectively as an attachment for an unmanned underwater vehicle of conventional type.

According to a further particular embodiment of the weapon clearance appliance, the means for the releasable connection of the weapon clearance appliance to an unmanned underwater vehicle and the retaining device are configured such that when activating the retaining device in order to fix the weapon clearance appliance to and/or in the region of the weapon, at the same time the means for the releasable connection are actuated so that a mechanical connection between the weapon clearance appliance and the unmanned underwater vehicle is released.

Such a simultaneous fastening of the weapon clearance appliance to and/or in the region of the weapon and detachment of the weapon clearance appliance from the unmanned water vehicle permits the use of conventional unmanned underwater vehicles, in particular mine destruction drones of conventional type, without having to alter the design thereof. In fact, the weapon clearance appliance is easily fastened to the underwater vehicle. When activating the retaining device for fixing the weapon clearance appliance to and/or in the region of the weapon, the weapon clearance appliance is released from the underwater vehicle at the same time so that the underwater vehicle can be moved to a safe distance away from the weapon.

Advantageously, therefore, the means for the releasable connection and the retaining device comprise at least one common integral unit which has the aforementioned nail-firing device. In this case, the integral unit comprises a casing, a nail, a bolt, a cartridge and a cartridge-firing device, as well as a retaining member for a fastening means for fastening the weapon clearance appliance to the unmanned underwater vehicle. The retaining member is in this case connected to the bolt via a drive element. Moreover, the nail, the bolt and the cartridge are aligned axially relative to one another inside the casing. With the activation of the cartridge-firing device which, for example, takes place by contact between the weapon clearance appliance and the weapon or by a metal sensor, the cartridge drives the bolt against the nail so that the nail is driven into a final position in the casing, in which it fastens the weapon clearance appliance to the weapon, and at the same time the retaining member is moved from an initial position in which the retaining member blocks the fastening means into a final position in which the fastening means is released. In other words, by activating the cartridge-firing device, a nail is driven into the weapon and at the same time the weapon clearance appliance is released from the unmanned underwater vehicle.

According to a further particular embodiment, the means for the releasable connection are configured in order to hold the weapon clearance appliance on a support frame of the unmanned underwater vehicle. According to this embodiment, it is provided for the weapon clearance appliance to be deposited by the unmanned underwater vehicle in the region of the weapon. Such an embodiment is advantageous when a direct fastening of the weapon clearance appliance to the weapon is not possible, for example due to severe shellfish growth. In such a case, the weapon clearance appliance is positioned in the region of the weapon at the bottom of the waterway and/or the seabed and then the clearance charge is fired and/or the spoof device activated.

FIGURES

Further particular embodiments are revealed from the exemplary embodiments described in more detail with reference to the drawings.

DETAILED DESCRIPTION

Figure 1:
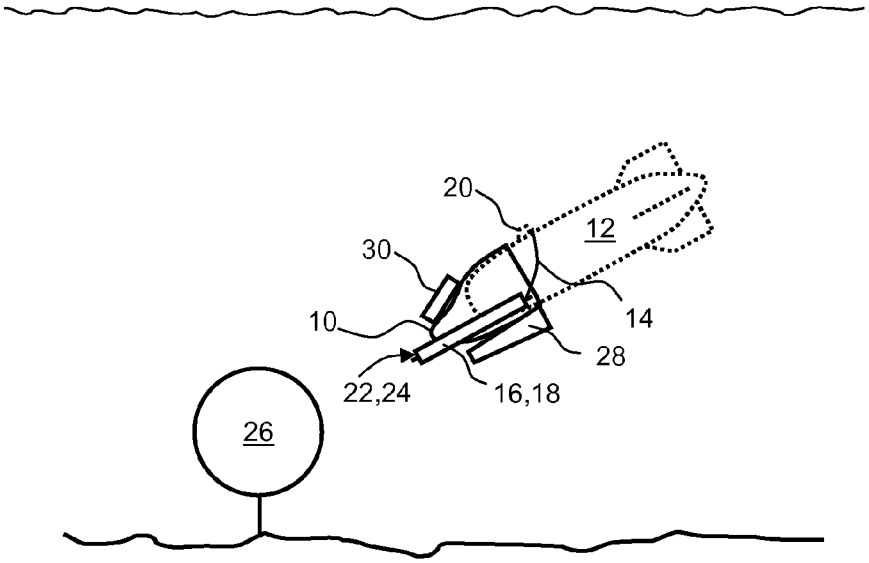
FIG. 1 shows an unmanned underwater vehicle with a weapon clearance appliance attached thereto according to a first exemplary embodiment of the invention when approaching an underwater mine.

FIG. 1 shows a weapon clearance appliance 10 which is configured as an attachment for an unmanned underwater vehicle 12 and is releasably fastened to the underwater vehicle 12.

The weapon clearance appliance 10 is arranged releasably fastened to the bow of the unmanned underwater vehicle 12, the weapon clearance appliance 10 being fixed to the unmanned underwater vehicle 12 by a fastening means 14 configured as an elastic band. Both ends of the elastic band 14 in each case act on an integral unit 16, 18 for providing both a retaining device for fixing the weapon clearance appliance 10 to the weapon and means for the releasable connection of the weapon clearance appliance 10 to the underwater vehicle 12. A central portion of the elastic band 14 acts on a projection 20 on the unmanned underwater vehicle 12. Due to the elasticity of the band 14, the weapon clearance appliance 10 is thus pulled and/or pushed in the manner of a cap onto the bow of the unmanned underwater vehicle 12 and thus fixed thereto. This attachment of the weapon clearance appliance 10 to the underwater vehicle 12 is, however, releasable. For releasing the mechanical connection between the weapon clearance appliance 10 and the unmanned underwater vehicle 12, the elastic band 14 is released from the integral units 16, 18. In the process, the connection between the weapon clearance appliance 10 and the underwater vehicle 12 is released and the underwater vehicle 12 is able to move away from the weapon clearance appliance 10.

The integral units 16, 18 in each case comprise a retaining device 22, 24 by means of which the weapon clearance appliance 10 is able to be fixed to a weapon, for example a mine 26. In FIG. 1, the mine 26 is shown as a moored mine. The mine 26, however, can also be configured as a conventional seabed mine. Moreover, the invention is not limited to the clearance of mines, but also relates to the clearance of munitions.

Figure 2:
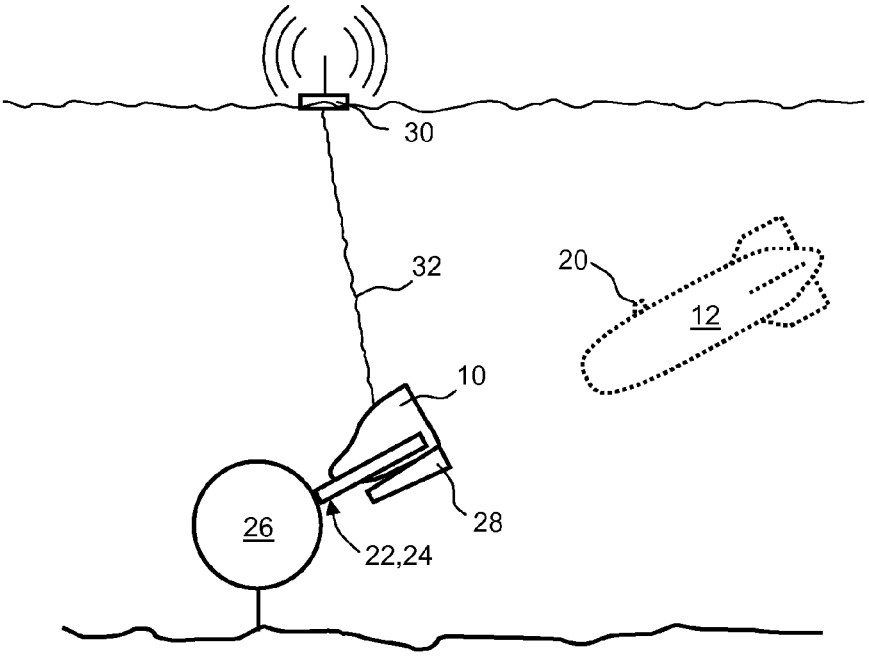
FIG. 2 shows the weapon clearance appliance according to FIG. 1 after the fixing thereof to the underwater mine as well as after detachment from the unmanned underwater vehicle.

FIG. 2 shows the weapon clearance appliance 10 of FIG. 1 after activation of the retaining devices 22, 24 on the mine 26.

Preferably, the retaining devices 22, 24 are configured as nail-firing devices, which use cartridges to drive nails into the mine 26 and by means of the nails fasten the weapon clearance appliance 10 to the mine 26.

Moreover, one or more shaped charges 28 are provided on the weapon clearance appliance 10, which in each case form a clearance charge with a directional effect.

Preferably, the direction of the clearance charge 28 faces in the same direction as the longitudinal axis of the retaining devices 22, 24 which in turn, when the weapon clearance appliance 10 is fixed to the underwater vehicle 12, preferably extends parallel to the longitudinal axis of the underwater vehicle. In this manner, the underwater vehicle 12 can be controlled frontally to a mine 26, as shown in FIG. 1, the weapon clearance appliance 10 being positioned on the bow of the underwater vehicle 12.

When the weapon clearance appliance 10 makes contact with the mine 26, or at least when the weapon clearance appliance 10 approaches significantly close to the mine 26, which is detected for example by means of a metal sensor, the retaining devices 22, 24 are activated so that the weapon clearance appliance 10 is fastened to the mine 26. At the same time, the elastic band 14 is released from the weapon clearance appliance 10 so that the unmanned underwater vehicle 12 is released from the weapon clearance appliance 10 and is able to move away.

In this manner, a conventional unmanned underwater vehicle 12 can transport a weapon clearance appliance 10, which is configured as an attachment, to a weapon, for example the mine 26. The weapon clearance appliance 10 is then fixed to the mine 26 by the weapon clearance appliance 10 making contact with the mine 26 and/or by significantly approaching the mine 26 as mentioned above. The weapon clearance appliance 10 is released from the underwater vehicle 12 at the same time or, possibly alternatively, subsequently, and the underwater vehicle 12 is moved away from the weapon 26 to a distance which is greater than or equal to a predetermined safety distance. Then the weapon clearance appliance 10 causes a detonation of the weapon 26 by a clearance charge, for example in the form of the aforementioned shaped charge 28 or a spoof device being activated, by means of which the mine 26 falsely perceives the presence of a marine vessel and/or submarine. Such simulation activates the mine's own firing mechanism so that the mine 26 is detonated.

According to the invention, due to the specific structural design of the weapon clearance appliance 10 the release of the weapon clearance appliance 10 from the underwater vehicle 12 does not produce any forces or torques on the underwater vehicle 12. This is achieved according to the invention by the volume of the weapon clearance appliance 10 being selected specifically so that the water displaced by the volume corresponds to the mass of the weapon clearance appliance 10. Due to this design, the buoyancy force acting on the weapon clearance appliance 10 under water compensates for the force of gravity acting on the weapon clearance appliance 10. The weapon clearance appliance 10 thus has neutral buoyancy. Thus, a release of the weapon clearance appliance 10 from the underwater vehicle 12 does not alter the (positive and/or negative) buoyancy characteristics of the underwater vehicle 12. This makes changing the trimming of the underwater vehicle 12 unnecessary after the release of the weapon clearance appliance 10.

Advantageously, the weapon clearance appliance 10 is also configured such that the buoyancy force acting on the weapon clearance appliance 10 under water acts at the same point as the force of gravity acting on the weapon clearance appliance 10. Thus, the weapon clearance appliance 10 "floats" in any position and/or alignment, so that irrespective of the alignment of the weapon clearance appliance 10 in the water no alignment moments occur which might attempt to alter the weapon clearance appliance 10 in its alignment. Such a mass distribution inside the weapon clearance appliance 10, on the one hand, ensures that the retaining devices 22, 24 are loaded as lightly as possible. In fact, such a mass distribution also results in the underwater vehicle 12 not having to be changed relative to its trimming after the weapon clearance appliance 10 has been released from the underwater vehicle 12, i.e. the underwater vehicle 12 does not have to be retrimmed.

The weapon clearance appliance 10 further comprises a radio buoy 30 which is connected via a line 32 to a fuse and/or a spoof device which is/are accommodated in the weapon clearance appliance 10.

The radio buoy 30 is a component of the weapon clearance appliance 10. However, it is released from the weapon clearance appliance 10 when the weapon clearance appliance 10 is fixed to the weapon (mine 26). At the same time, a buoyant body on the radio buoy 39 is activated which ensures the radio buoy 30 is buoyant. Alternatively, the radio buoy 30 provides buoyancy itself, which is compensated by the remaining part of the weapon clearance appliance 10.

The radio buoy 30 serves for receiving an activation signal via a radio link from a control platform, for example a mother vessel, which for example can be a mine sweeper.

Figure 3:
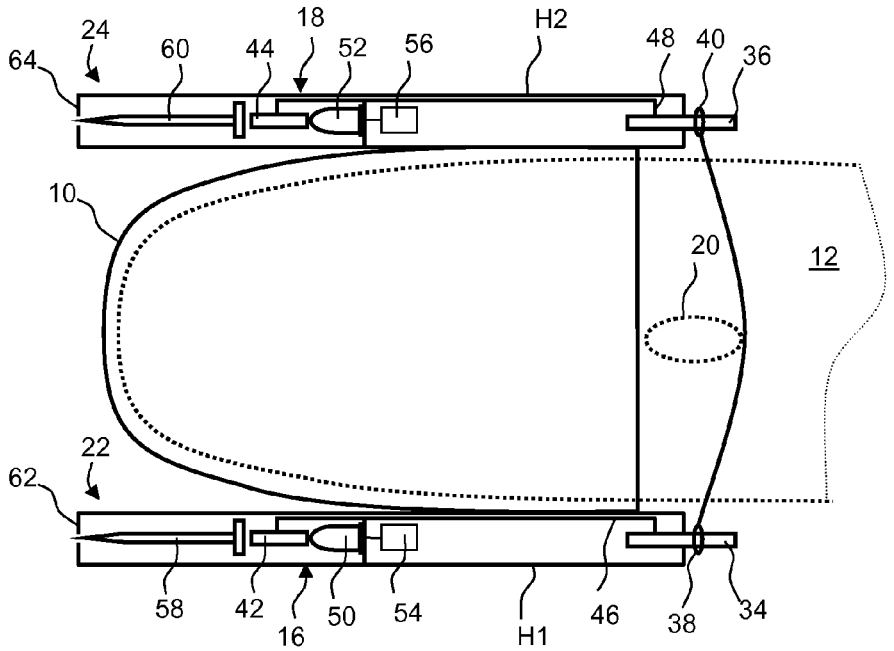
FIG. 3 shows a simplified view of a weapon clearance appliance according to FIGS. 1 and/or 2 with a simplified view in each case of an integral unit for accommodating means according to the invention for the releasable connection of the weapon clearance appliance to the underwater vehicle and retaining devices for fixing the weapon clearance appliance to a weapon.

FIG. 3 illustrates the weapon clearance appliance 10 in a view from above and namely when fixed by means of the elastic band 14 to the projection 20 of the underwater vehicle 12. The basic design of the integral units 16, 18 is, however, shown in more detail.

The integral units 16, 18 firstly accommodate the aforementioned means for the releasable connection of the weapon clearance appliance 10 to the under-water vehicle 12. Secondly, the integral units 16, 18 accommodate the retaining devices 22, 24 for fixing the weapon clearance appliance 10 to a weapon 26.

The means for the releasable connection comprise, in particular, the elastic band 14 as well as one respective retaining member 34, 36, which in each case is arranged in an axially displaceable manner inside a casing H1 and/or H2 of the integral unit 16 and/or 18. The elastic band 14 has at each of its ends one respective loop 38, 40, which clasps one respective retaining member 34, 36.

At the start, the retaining members 34, 36 are located in an initial position shown in FIG. 3, permitting such a clasping of the loops 38, 40. In this initial position, in each case a portion of each of the retaining members 34, 36 protrudes from the respective integral units 16, 18 configured in the manner of a casing. Each retaining member 34 and/or 36 is connected to a bolt 42 and/or 44 via a drive element 46 and/or 48. The drive element 46 and/or 48 ensures that the respective retaining member 34 and/or 36 moves together with the respective bolt 42 and/or 44.

The bolt 42 and/or 44 is driven by a cartridge 50 and/or 52, which is fired by a cartridge-firing device 54 and/or 56. The cartridge-firing device 54 and/or 56 is in each case only shown schematically. The cartridge-firing devices 54, 56 are, for example, a release mechanism, which is released by contact of the weapon clearance appliance 10 with an object and/or a metal detector.

The firing of the cartridge 50 and/or 52 results in the bolt 42 and/or 44 being driven. In the view according to FIG. 3, the bolt 42 and/or 44 is moved to the left. Such a movement of the bolt 42, 44 ensures that a nail 58 and/or 60 is driven into a final position against a base plate 62 and/or 64 of the casing H1 and/or H2. The nails 58, 60 have sufficient strength in order to be able to penetrate a steel casing of a mine and/or munitions.

If shellfish growth has already formed on the mine 26 and/or the munitions, the growth is destroyed due to the high energy of the cartridge 50 and/or 52, and the weapon clearance appliance 10 is securely fastened to the weapon 26. In this case it is advantageous that the elastic band 14 is released from the retaining members 34, 36 at the same time as the nails 58, 60 are driven forward. In this manner, only a small mass of the weapon clearance appliance 10 has to be accelerated, when penetrating the shellfish growth. Nevertheless, the far greater mass of the unmanned underwater vehicle 12 does not additionally have to be moved towards the weapon.

Figure 4:
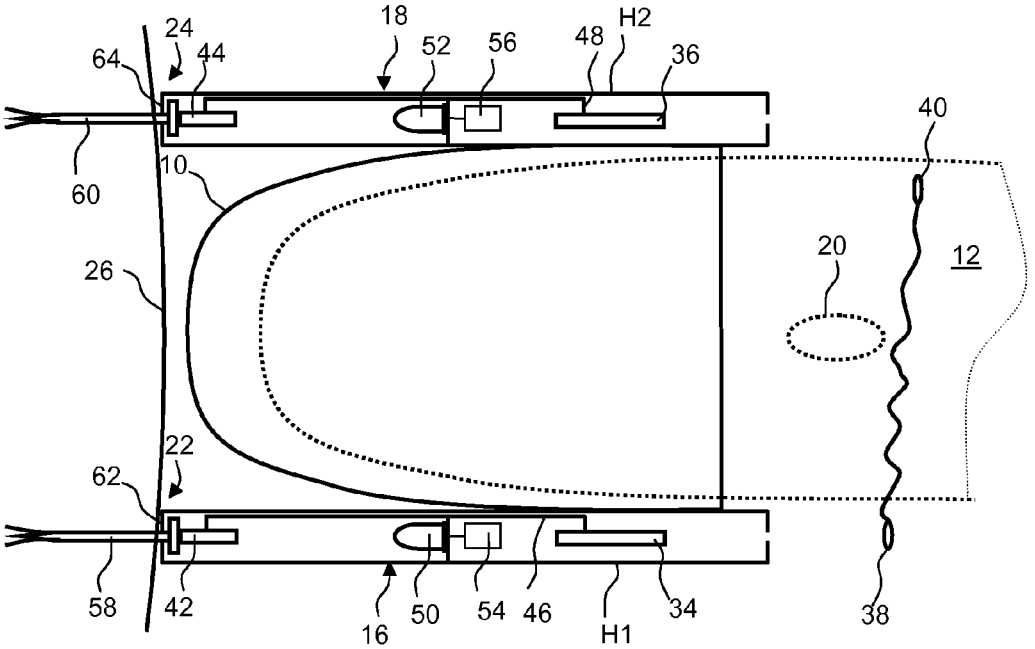
FIG. 4 shows the weapon clearance appliance according to FIG. 3 after fixing to the underwater mine.

FIG. 4 shows the integral units 16, 18 after firing the cartridges 50, 52. After firing the cartridge 50 and/or 52, the bolt 42 and/or 44 has driven the nail 58 and/or 60 into the body of the mine 26. The tip of the nail 58 and/or 60 widens during this process and thus ensures that the nail 58 and/or 60 is not able to be pulled out of the mine 26 again.

FIG. 4 further illustrates that the retaining members 34, 36 have been pulled into the inside of the respective integral unit 16 and/or 18 via the drive elements 46 and/or 48. Thus, the loops 38, 40 of the elastic band 14 have lost their respective hold and thus the connection between the unmanned underwater vehicle 12 and the weapon clearance appliance 10 is released.

Two integral units 16, 18 with two retaining devices 22, 24 as well as in each case two retaining members 34, 36, two bolts 42, 44, two drive elements 46, 48, two cartridges 50, 52, two cartridge-firing devices 54, 56, two nails 58, 60 and two base plates 62, 64 are described in the above description of the figures. The invention, however, is not restricted to such a duplicated configuration. In fact, it is possible for there to be only one of the aforementioned components to fasten the weapon clearance appliance 10 securely to the weapon 26, even with a configuration using one of each component. In the case of a configuration using one of each component, however, the two loops 38, 40 of the elastic band 14 have to be secured to the same retaining member.

Moreover, more than two integral units and/or retaining devices can also be provided with the associated components.

Figure 5:
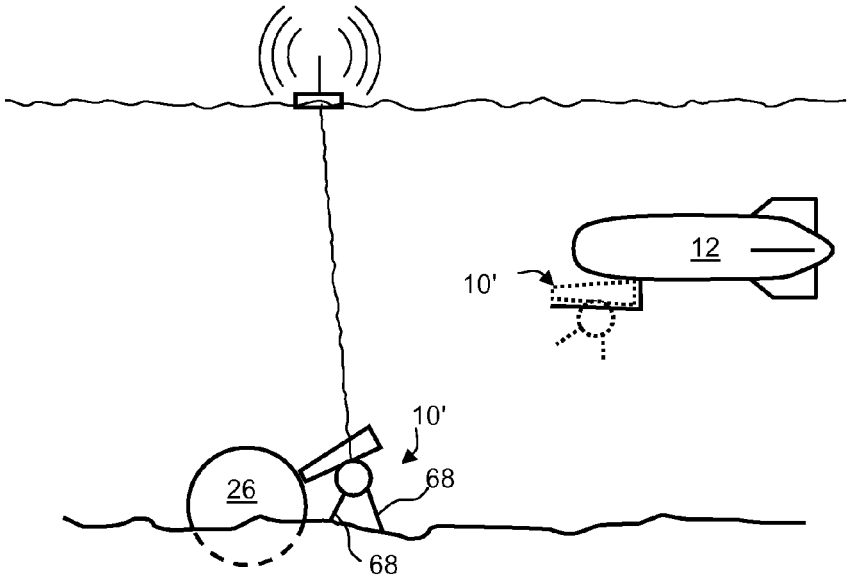
FIG. 5 shows a weapon clearance appliance according to an alternative exemplary embodiment of the invention.

FIG. 5 shows a further exemplary embodiment of a weapon clearance appliance 10' and namely in a view with dashed lines when attached to a support frame on an underwater vehicle 12. In the view with solid lines, the weapon clearance appliance 10' is positioned in the region of a seabed mine 26. In this embodiment, the weapon clearance appliance 10' has a plurality of, in particular three, legs 68, which provide the weapon clearance appliance 10' with a secure hold.

In such an embodiment of the weapon clearance appliance 10' the weapon clearance appliance 10' is simply positioned in the immediate vicinity of the weapon 26 but not fixed to the weapon 26. Such a procedure is advantageous, in particular, when a seabed mine 26 has already sunk into the sediment. In this case, there is a greater chance of success when a clearance charge with a directional effect is arranged as close as possible to the mine 26 and the clearance charge is fired.

As a result of the invention, it is possible to provide conventional unmanned underwater vehicles, in particular mine hunting drones, with a multiple use, as the actual weapon clearance appliance 10 is only provided as an attachment to the underwater vehicle 12. Thus, only the weapon clearance appliance 10 has to be sacrificed with each use, whilst the unmanned underwater vehicle 12 can be reused. In this manner, the costs of mine clearance can be significantly reduced. As a result, the clearance of the weapons 26, of which many are still located on the seabed, in particular from both world wars, is significantly more cost-effective. As a result, the number of mine clearances can be considerably controlled which improves maritime and environmental safety.

All of the features cited in the above description and in the claims are able to be used both individually and in any combination with one another. The disclosure of the invention is thus not limited to the disclosed and/or claimed combination of features. Instead, all combinations of features are to be considered as disclosed.

What is claimed is:

1. A weapon clearance appliance for clearing underwater weapons, such as mines or munitions, that have been sunk in waterways, under water by detonation of the weapon, said weapon clearance appliance comprising:

a retaining device structured and operable to fix the weapon clearance appliance to the weapon; and a means for the releasable connection of the weapon clearance appliance to an unmanned underwater vehicle; wherein the means for releasable connection of the weapon clearance to the unmanned underwater vehicle and the retaining device are structured and operable such that when activating the retaining device in order to fix the weapon clearance appliance to the weapon, at the same time, the means for the releasable connection is actuated such that a mechanical connection between the weapon clearance appliance and the release of the unmanned underwater vehicle occur at the same time.

2. The weapon clearance appliance according to claim 1, wherein the means for the releasable connection and the retaining device comprise at least one common integral unit.

3. The weapon clearance appliance according to claim 2, wherein the integral unit comprises a nail-firing device, a casing, a nail, a bolt, a cartridge, a cartridge-firing device, and a retaining member structured and operable to fasten the weapon clearance appliance to the unmanned underwater vehicle.

4. The weapon clearance appliance according to claim 3, wherein with the activation of the cartridge-firing device the cartridge drives the bolt against the nail, so that the nail is driven into a final position in the casing and at the same time the retaining member is moved from an initial position in which it blocks the fastening means into a final position in which the fastening means is released.

5. The weapon clearance appliance according claim 4, wherein a buoyancy force acting on the weapon clearance appliance compensates a force of gravity acting on the weapon clearance appliance.

6. The weapon clearance appliance according to claim 5, wherein a mass distribution inside the weapon clearance appliance is selected such that, irrespective of an alignment of the weapon clearance appliance in the water, an alignment moment does not act on the weapon clearance appliance.

7. The weapon clearance appliance according to claim 6 further comprising:

at least one clearance charge with a directional effect: and a fuse for firing the at least one clearance charge.

8. The weapon clearance appliance according to claim 7, wherein the at least one clearance charge with a directional effect comprises at least one shaped charge.

9. The weapon clearance appliance according to claim 7 further comprising a spoof device structured and operable to simulate characteristics of a marine vessel or submarine.

10. The weapon clearance appliance according to claim 9, wherein the spoof device is structured and operable to generate at least one of a marine vessel noise, a submarine noise, and a magnetic field.

11. The weapon clearance appliance according to one of claim 10 further comprising a means for activating at least one of the fuse and the spoof device, the means comprising at least one of:

a radio buoy releasable from the weapon clearance appliance and structured and operable to receive an activation signal via a radio link;

an electro-acoustic transducer structured and operable to receive an activation signal via an acoustic channel;

a firing cable structured and operable to receive an activation signal via the firing cable; and a time fuse mechanism.

12. The weapon clearance appliance according to claim 11, wherein the retaining device comprises at least one of:

a nail-firing device;

an electromagnet, a reduced-pressure device; and a clamping device structured and operable to clamp at least one of the weapon, parts thereof, and objects in the region of the weapon.

13. The weapon clearance appliance according to claim 12, wherein the retaining member is connected to the bolt via a drive element, and wherein the nail, the bolt and the cartridge are aligned axially relative to one another inside the casing.

14. The weapon clearance appliance according to claim 13, wherein the means for the releasable connection is structured and operable to hold the weapon clearance appliance on a support frame of the unmanned underwater vehicle.

15. An unmanned underwater vehicle, said vehicle comprising:

a weapon clearance appliance, wherein the weapon clearance device comprises:

a retaining device structured and operable to fix the weapon clearance appliance to the weapon; and a means for the releasable connection of the weapon clearance appliance to an unmanned underwater vehicle; wherein the means for releasable connection of the weapon clearance to the unmanned underwater vehicle and the retaining device are structured and operable such that when activating the retaining device in order to fix the weapon clearance appliance to the weapon, at the same time, the means for the releasable connection is actuated such that a mechanical connection between the weapon clearance appliance and the release of the unmanned underwater vehicle occur at the same time.

* * * * *